US005233703A

United States Patent [19]

Galka

[11] Patent Number: 5,233,703

[45] Date of Patent: Aug. 10, 1993

[54] HEADWEAR WITH IDENTIFICATION POCKET

[76] Inventor: Gordon P. Galka, 2261 Juniper Ct., Golden, Colo. 80401

[21] Appl. No.: 801,874

[22] Filed: Dec. 3, 1991

[51] Int. Cl.[5] ..... A42B 1/24

[52] U.S. Cl. ..... 2/209.13; 2/10; 2/195.1; 2/918

[58] Field of Search ..... 2/10, 12, 15, 171, 185 R, 2/186, 195, 196, 199, 209.1, 422; 40/329

[56] References Cited

U.S. PATENT DOCUMENTS

| | | | |
|---|---|---|---|
| 324,073 | 8/1885 | Baruch et al. . | |
| 1,161,637 | 11/1915 | Dunn . | |
| 1,610,241 | 12/1926 | Billings . | |
| 2,615,168 | 10/1952 | Tannenbaum . | |
| 2,640,992 | 6/1953 | Hassler . | |
| 2,744,256 | 5/1956 | Slotkin et al. . | |
| 2,803,829 | 8/1957 | Tscharner . | |
| 4,312,076 | 1/1982 | Gamm . | |
| 4,386,437 | 6/1983 | Fosher . | |
| 4,667,274 | 5/1987 | Daniel | 2/199 |
| 4,827,384 | 5/1989 | Von Schlemmer . | |
| 4,985,935 | 1/1991 | Hur | 2/10 |

*Primary Examiner*—Clifford D. Crowder
*Assistant Examiner*—Diana L. Biefeld
*Attorney, Agent, or Firm*—John E. Reilly

[57] ABSTRACT

A head covering, such as, a cap of the type having a visor and head-encircling portion is provided with an identification pocket formed in the visor by upper and lower panels disposed in closely spaced parallel relation to one another, the lower panel being separable from the upper panel to form an entrance for insertion of an identification card into the pocket formed between the panels. In one form, the lower panel is of a smaller size than the upper panel and attached in centered relation to the upper panel with a separable edge portion facing inwardly toward the head-encircling portion of the cap; and in an alternate form the lower panel is coextensive with the upper panel and has an inner edge portion releasably secured to the inner edge portion of the upper panel to form an entrance for insertion of identification cards therein.

15 Claims, 1 Drawing Sheet

HEADWEAR WITH IDENTIFICATION POCKET

This invention relates to headwear; and more particularly relates to novel and improved headwear of the type having a built-in pocket for identification cards, licenses and the like.

BACKGROUND AND FIELD OF INVENTION

Various types of head coverings are in use for recreational activities, such as, tennis, volley ball and fishing. In participating in these activities, it is desirable to be able to carry one's identification in a safe but hidden part of the head covering or cap. For example, in going to the beach, it is virtually impossible to safely carry identification, credit cards and the like on one's person without danger of loss or damage.

It has been proposed in the past to provide head coverings with pockets for the retention and safekeeping of identification and other small articles. For example, U.S. Pat. No. 2,640,992 to K. Hassler provides for a relatively large space formed between visor portions of a cap but requires substantially complete reconstruction of the cap and is intended more for carrying larger articles, such as, cigarette packages, keys and money.

U.S. Pat. No. 4,827,384 to H. Von Schlemmer is directed to a pocket which is formed more between the crown and visor portion of the cap and intended to hold larger objects, such as, a flashlight. U.S. Pat. No. 2,615,168 to M. L. Tannenbaum shows a sport cap with a zippered pocket in the crown of the cap. U.S. Pat. No. 2,744,256 to G. B. Sotkin et al discloses a cap with built-in pockets including a zippered pocket in the bill of the cap. U.S. Pat. No. 4,312,076 to R. J. Gamm discloses a pocket in the head covering or crown portion of the cap having a Velcro closure.

There is nevertheless a continuing need for a head covering in which an identification pocket can be incorporated into the visor or brim of the head covering with a minimum of modification required to the construction of the head cover itself and in such a way as not to detract from the appearance of the head covering; also to permit safe storage of smaller articles without being visible to others except when it is necessary to use or produce the articles, for example, for identification purposes.

SUMMARY OF THE INVENTION

It is therefore an object of the present invention to provide for a novel and improved head covering in which identification can be carried in a safe and dependable manner.

It is another object of the present invention to provide an identification pocket for headwear which is readily conformable for use with virtually any type of brim or visorlike hat without substantially altering its appearance or construction.

It is a further object of the present invention to provide for alternate forms of identification pockets which can be incorporated into the underside of a visor or brim for a hat in such a way as to safely store identification and other small articles and yet be easy to produce or use when needed.

It is a further object of the present invention to provide in a cap for a novel and improved identification pocket which can be incorporated into the cap without altering its external appearance and will safely store identification without being visible or discernible to others.

It is an additional object of the present invention to provide in a visor-like cap for novel and improved forms of identification pockets which can be incorporated into the underside of the visor and which will afford convenient access to items such as a driver's license or fishing license.

In accordance with the present invention, there has been devised a head covering of the type having a visor and a flexible head-encircling portion, the visor extending outwardly from the head-encircling portion and being of generally crescent-shaped configuration having upper and lower panels in closely spaced relation to one another to define a shallow pocket therebetween, connecting means for connecting an outer peripheral edge of a lower panel to the upper panel, the upper panel including an inner edge attached to the head-encircling portion, a peripheral edge portion of the lower panel being separable from the upper panel to form an entrance for insertion of an identification card into the pocket between the upper and lower panels.

In a preferred form, the lower panel is a flexible material which will permit expansion of the pocket to insert articles therein and has a transparent portion for viewing articles placed in the pocket. Further, the lower panel is of a limited size with respect to the upper panel and is secured in centered relation to the upper panel with an inner edge portion facing inwardly toward the head-encircling portion to define an entrance for insertion of an identification card into the pocket. In a modified form, the lower panel is coextensive with the upper panel and a peripheral edge portion extends along the inner edge of the upper panel with a releasable closure therebetween to permit opening of the pocket for insertion of an identification card therein.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
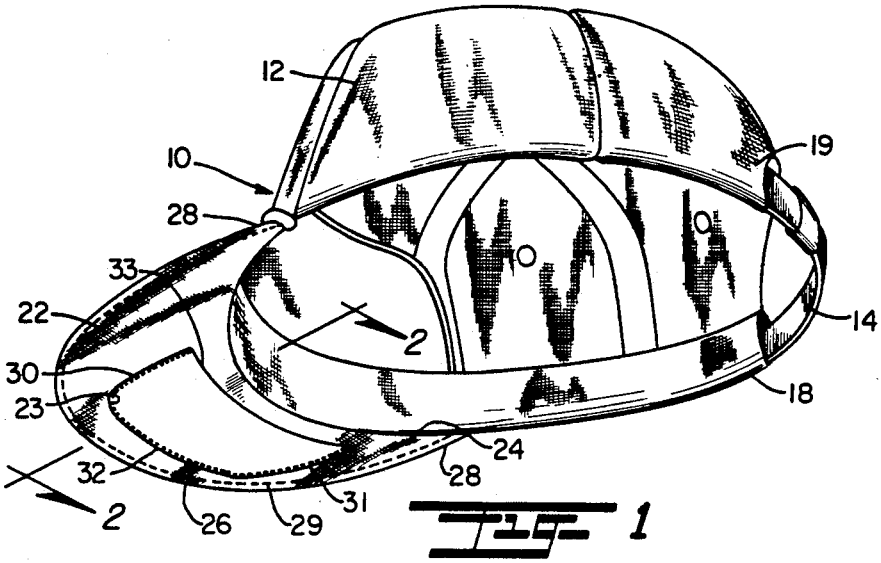
FIG. 1 is a somewhat perspective view of the underside of a cap illustrating a preferred form of identification pocket therein.
Figure 2:
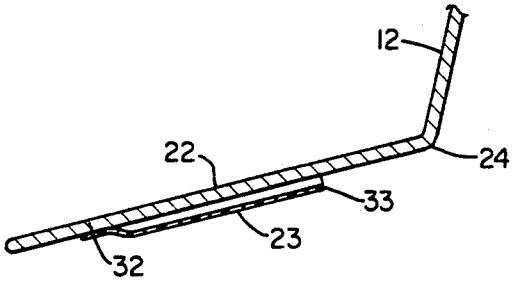
FIG. 2 is a cross-sectional view taken about lines 2—2 of FIG. 1.

Referring in more detail to the drawings, there is shown in FIGS. 1 and 2 a preferred form of cap 10 having a crown 12, a flexible head-encircling band 14 at the lower edge of the crown, and a brim or visor 16 extending outwardly and away from the lower edge of the band 14. As such, the cap 10 is representative of various conventional hat constructions designed for outdoor or recreational use and which are provided with the band 14, with or without a crown 12, and where the band 14 either partially or fully encircles the head of the wearer so as to secure the visor in place as a sunshade over the eyes.

In the form of invention shown in FIGS. 1 and 2, the band 14 is of standard construction having one or more layers of a fabric material including an inner layer 18 serving as a sweatband, and the crown 12 extends upwardly as a continuation of an outer layer 19 of the band 14.

The visor or brim 16 preferably is of generally crescent-shaped configuration having upper and lower layers or panels 22 and 23 which define a shallow pocket therebetween. The upper panel 22 extends the full length and width of the visor and has an inner edge 24 secured by stitching to the lower edge of the band 14. An outer peripheral edge 26 of the panel is of generally curvilinear configuration with opposite side edges 28 intersecting the inner edge 24 at the points of attachment to the band 14. Typically, the upper panel 22 is relatively inflexible and may for example be comprised of a cardboard stiffener member covered with a fabric lining on both sides and where the linings are secured together to the stiffener by suitable stitching as designated by dotted lines 29. The lower panel 23 is substantially smaller than the upper panel 22 and is of generally rectangular configuration having opposite ends 30, 31 and one side 32 secured by stitching to the lower or undersurface of the upper panel 22. Preferably, the lower panel 23 is centered in relation to the upper panel and has an inner edge 33 which is unattached to the upper panel and faces inwardly toward the inner edge 24 of the visor so as to leave a gap or entrance into the pocket formed between the panels 22 and 23 for insertion of an I.D. card, credit card or the like. The lower panel 23 is somewhat more flexible than the upper panel to the extent necessary to permit it to be separated from the upper panel for insertion of a card through the entrance and while leaving a limited clearance between the panels for snug-fitting retention of the card. Also, at least a portion of the lower panel can be transparent so as to permit viewing of the card without necessity of removal from the pocket formed between the panels.

Figure 4:
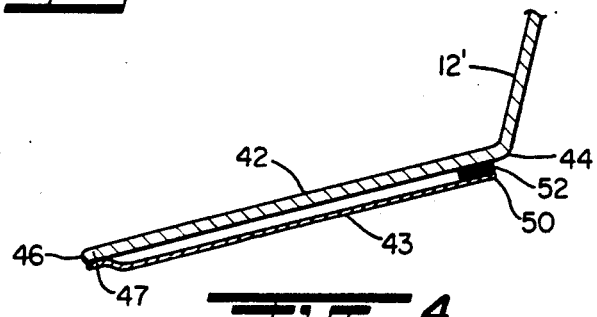
FIG. 4 is a cross-sectional view taken about lines 4—4 of FIG. 3.
Figure 3:
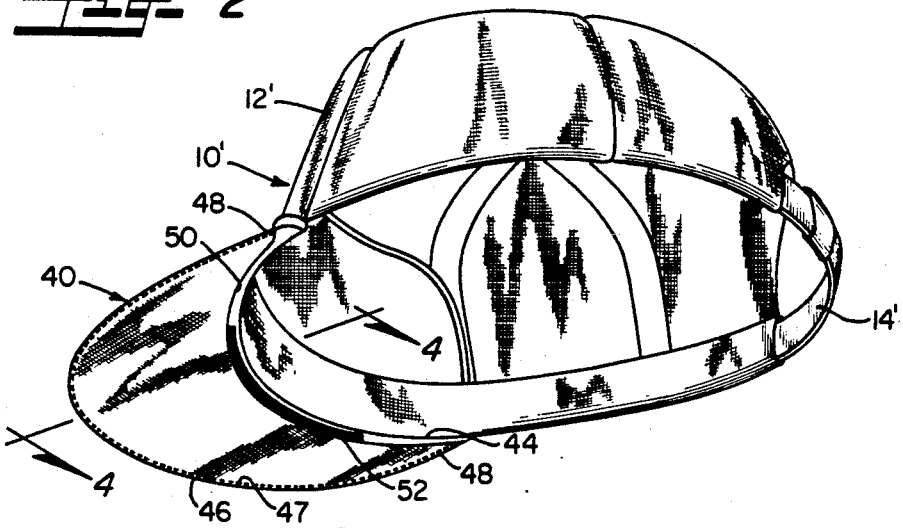
FIG. 3 is a perspective view of the underside of a cap illustrating a modified form of identification pocket therein.

A modified form of cap is illustrated in FIGS. 3 and 4 wherein like parts or components to those of FIGS. 1 and 2 are correspondingly enumerated with prime numerals. Accordingly, the cap 10' includes a crown 12', flexible head-encircling band 14' and visor 40. As in the preferred form, the visor 40 is of generally crescent-shaped configuration and is made up of upper and lower layers or panels 42 and 43 both of which extend the full length and width of the visor. The upper panel has an inner edge 44 secured by seaming to the lower edge of the band 14' and an outer peripheral edge 46 is of curvilinear configuration and provided with opposite side edges 48 which join with the inner edge 44 along the securement to the band 14'. Again, the upper panel 42 is typically made up of a cardboard stiffener or other suitable material covered with fabric lining on its upper or outer surface as described in connection with the panel 22. However, the lower panel 43 as described is coextensive with the upper panel 42 and is secured at its outer peripheral edge by stitching 47 to the outer peripheral edge 46 of the upper panel. However, an inner edge 50 of the lower panel 43, which is coextensive with the inner edge 44 of the upper panel, is removably attached to the inner edge 44 of the upper panel by a Velcro closure 52 along an intermediate portion between the edges 50 and 44. In a well-known manner, the Velcro closure consists of complementary strips of hook and loop fasteners secured, respectively, along confronting surfaces of the inner edges 44 and 50.

In the modified form, the lower panel 43 may be composed of a fabric or reinforced fabric material which when attached along the Velcro closure will lay snugly against the upper panel 42; however, when the closure is released, the lower panel is sufficiently flexible that it can be opened a slight amount for insertion of identification cards, such as, a driver's license or fishing license. In the modified form, the limited area or pocket formed between the panels 42 and 43 will permit placement of one or more cards and retain them within the visor so as not to be visible to others.

In the preferred and modified forms as described, it will be evident that the identification pockets are readily conformable for use with standard cap constructions with a minimum of alteration or modification required. Yet, by placing along the lower or undersurface of the visor, are readily accessible for removal or placement of identification into the pocket and are snugly retained in place without being discernible to others and without altering the appearance of the cap itself. The panel construction making up the pockets may be suitably varied in accordance with the material employed in the construction of the cap itself and lends itself well to being added to existing caps by placement of the lower panel portion along the underside of the visor as described. The preferred form of invention also lends itself particularly well to placement over a limited undersurface of the visor when desired for retention of a single card which would occupy very little space. On the other hand, the modified form of invention would be more appropriate for use in storing a plurality of cards or articles and being able to uniformly distribute them over the width of the visor so as not to create any concentrated weight in the cap.

It is therefore to be understood that the above and other modifications and changes may be made in the construction and arrangement of elements comprising the preferred and alternate forms of the invention without departing from the spirit and scope thereof as defined by the appended claims.

I claim:

1. In a head covering wherein there is provided a flexible head-encircling portion and a brim extending outwardly from said head-encircling portion, the improvement comprising:

said brim having upper and lower panels in closely spaced relation to one another to define a hollow pocket therebetween, means connecting an outer peripheral edge of said lower panel to said upper panel, said upper panel including an inner edge attached to said head-encircling portion, a peripheral edge portion of said lower panel being separable from said upper panel to form an extrance for insertion of an identification card into said pocket between said panels, and said lower panel including a transparent portion for viewing articles placed in said pocket.

2. In a head covering according to claim 1, said lower panel being of a flexible material for expansion of said pocket to insert articles therein.

3. In a head covering according to claim 1, said lower panel being coextensive with said upper panel, said peripheral edge portion of said lower panel extending along said inner edge of said upper panel.

4. In a head covering of the type including a flexible head-encircling portion and a visor having an inner edge adjacent to said head-encircling portion, and an outer peripheral edge of generally curvilinear configuration extending outwardly from said inner edge, the improvement comprising:

said visor being a generally crescent-shaped section attached along said inner edge thereof to a lower edge of said head-encircling portion, said visor having upper and lower panels in closely spaced relation to one another, means permanently attaching an outer peripheral edge of said lower panel to an outer peripheral edge of said upper panel a portion of said lower panel being separable from said upper panel along a limited portion therebetween along a limited portion therebetween to form an internal pocket between said upper and lower panels of said visor.

5. In a head covering according to claim 4, said lower panel being coextensive with said upper panel, an inner edge of said lower panel extending along an inner edge of said upper panel and including a releasable closure therebetween.

6. In a head covering to claim 4, said lower panel being of a flexible material to permit expansion of said pocket for insertion of articles therein.

7. In a head covering according to claim 6, said limited portion of said lower panel facing in a direction inwardly towards said head-encircling portion to form an extrance into said pocket.

8. In a head covering according to claim 7, said lower panel being composed of a transparent material for viewing articles placed within said pocket.

9. In a head covering wherein there is provided a flexible head-encircling portion and a brim extending outwardly from said head-encircling portion, the improvement comprising:

said brim having upper and lower panels in closely spaced relation to one another to define a hollow pocket therebetween, means connecting another peripheral edge of said lower panel to said upper panel, said upper panel including an inner edge attached to said head-encircling portion, a peripheral edge portion of said lower panel being separable from said upper panel to form an entrance for insertion of an identification card into said pocket between said panels, and said upper panel composed of a material of limited flexibility, said lower panel being smaller than said first panel and being disposed in centered relation to said upper panel.

10. In a head covering according to claim 9, said peripheral edge portion of said lower panel facing inwardly toward said head-encircling portion.

11. In a head covering according to claim 9, said lower panel being smaller than said first panel and being of generally rectangular configuration having opposite ends and an outer edge permanently affixed to said upper panel.

12. In a head covering wherein there is provided a flexible head-encircling portion and a brim extending outwardly from said head-encircling portion, the improvement comprising:

said brim having upper and lower panels in closely spaced relation to one another to define a hollow pocket therebetween, means connecting an outer peripheral edge of said lower panel to said upper panel, said upper panel including an inner edge attached to said head-encircling portion, a peripheral edge portion of said lower panel being separable from said upper panel to form an entrance for insertion of an identification card into said pocket between said panels, and said lower panel being coextensive with said upper panel, said peripheral edge portion of said lower panel extending along said inner edge of said upper panel.

13. In a head covering according to claim 12, including a releasable closure extending between said peripheral edge portion of said lower panel and said inner edge of said upper panel.

14. In a head covering according to claim 13, said releasable closure defined by Velcro strips extending along intermediate portions of said peripheral edge portion and said inner edge.

15. In a head covering of the type including a flexible head-encircling portion and a visor extending outwardly from a lower edge of said head-encircling portion, the improvement comprising:

said visor being a generally crescent-shaped section attached along an inner edge thereof to said lower edge of said head-encircling portion, said visor having upper and lower panels in closely spaced relation to one another, means attaching an outer peripheral edge of said lower panel to said upper panel except along a limited portion therebetween to form an internal pocket between said upper and lower panels of said visor, said limited portion of said lower panel being of a flexible material and said limited portion facing inwardly in a direction towards said head-encircling portion to form an entrance into said pocket.

* * * * *